US012735887B2

(12) United States Patent
Wessman

(10) Patent No.: US 12,735,887 B2
(45) Date of Patent: Sep. 15, 2026

(54) METHOD FOR DETERMINING A PUMP STATION CAPACITY MEASURE

(71) Applicant: Xylem Europe GmbH, Schaffhausen (CH)

(72) Inventor: Martin Wessman, Solna (SE)

(73) Assignee: Xylem Europe GmbH, Schaffhausen (CH)

( * ) Notice: Subject to any disclaimer, the term of this patent is extended or adjusted under 35 U.S.C. 154(b) by 387 days.

(21) Appl. No.: 18/566,422

(22) PCT Filed: Jun. 2, 2022

(86) PCT No.: PCT/EP2022/065017

§ 371 (c)(1),
(2) Date: Dec. 1, 2023

(87) PCT Pub. No.: WO2022/253944

PCT Pub. Date: Dec. 8, 2022

(65) Prior Publication Data

US 2024/0263434 A1 Aug. 8, 2024

(30) Foreign Application Priority Data

Jun. 3, 2021 (EP) ..... 21177584

(51) Int. Cl.
*E03F 5/22* (2006.01)

(52) U.S. Cl.
CPC ..... *E03F 5/22* (2013.01)

(58) Field of Classification Search
CPC .. E03F 5/22; F04D 13/12; F04D 13/16; F04D 15/0088
See application file for complete search history.

(56) References Cited

U.S. PATENT DOCUMENTS 2,253,152 A * 8/1941 Towler ..... F04B 53/162 417/570
2,475,414 A * 7/1949 Towler ..... B30B 15/22 60/430

(Continued)

FOREIGN PATENT DOCUMENTS

CN 106906892 A 6/2017
CN 210457859 U 5/2020

(Continued)

OTHER PUBLICATIONS

International Search Report and Written Opinion for International Application No. PCT/EP2022/065017, dated Sep. 23, 2022, 9 pages.

*Primary Examiner* — Ziaul Karim
(74) *Attorney, Agent, or Firm* — Buchanan Ingersoll & Rooney PC

(57) ABSTRACT

A method for determining a Pump Station Capacity Measure (PSCM) value in relation to a theoretical or actual Precipitation Event in the area of the pump station comprising a tank for temporary storage of a liquid, an inlet for influent liquid, an outlet, and at least one pump configured for transporting the liquid away from the tank via the outlet. The method comprises steps. Determining a Precipitation Inflow character (IN-RAIN) of the pump station representative of the inflow of the influent liquid to the pump station originating from the Precipitation Events in the area of the pump station. Determining a Dry Inflow character (IN-DRY) of the pump station representative of the inflow of the influent liquid to the pump station not originating from the Precipitation Events. Determining a Pump Station Max Capacity (PSMC) that is representative for the maximum output capacity of the pump station.

19 Claims, 1 Drawing Sheet

(56) References Cited

U.S. PATENT DOCUMENTS

| | | | | |
|---|---|---|---|---|
| 2009/0291337 | A1* | 11/2009 | Tamura | C01B 3/48 429/412 |
| 2013/0287943 | A1* | 10/2013 | Kreiselmaier | B65H 75/4407 427/236 |
| 2018/0340389 | A1* | 11/2018 | Wang | E21B 28/00 |
| 2018/0355830 | A1* | 12/2018 | Landenberger | F04B 53/102 |

FOREIGN PATENT DOCUMENTS

| | | | |
|---|---|---|---|
| JP | 1080695 | A | 3/1998 |
| WO | 2004038343 | A1 | 5/2004 |

* cited by examiner

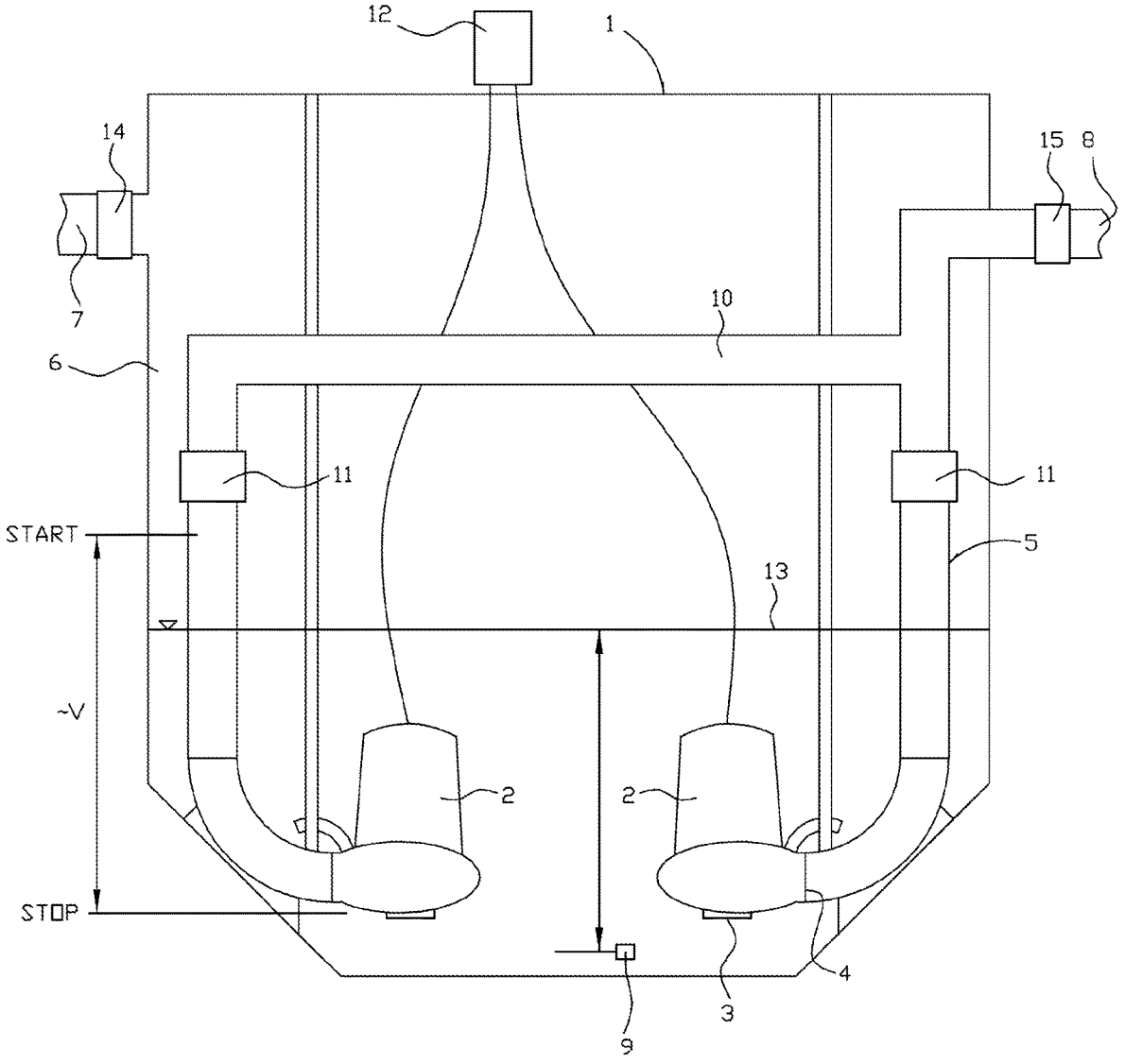
12
1
14
15
8
7
10
6
11
11
START
5
13
~V
2
2
STOP
4
3
9

METHOD FOR DETERMINING A PUMP STATION CAPACITY MEASURE

CROSS-REFERENCE TO RELATED APPLICATIONS

This is the U.S. National Phase of International Application No. PCT/EP2022/065017, filed Jun. 2, 2022, which claims priority to European Application No. 21177584.6, filed Jun. 3, 2021. The disclosure of each of these applications is incorporated herein by reference in its entirety for all purposes.

TECHNICAL FIELD OF THE INVENTION

The present invention belongs to the technical field of pump stations and methods for monitoring and control of pump stations, especially pump stations configured for pumping liquid comprising solid matter, such as wastewater, and especially a method for determining a pump station capacity measure. The pump station comprises a tank for temporary storage of a liquid, an inlet for influent liquid, an outlet and at least one pump configured for transporting the liquid away from the tank via said outlet.

BACKGROUND OF THE INVENTION

A pump station typically has a reservoir for holding a liquid, such as a well, a sump, a holding tank or a tank. In some pump stations, there may be multiple wells/sumps that are separated from or connected to each other. One or more pumps can be used to transport liquid into or out of the reservoir. For example, pumps may be used to transport sewage out of sumps in sewage pump stations, or to pump fresh water into holding tanks in clean water boost stations.

A typical liquid reservoir for wastewater has an inlet to admit liquid to enter the tank and an outlet through which the liquid is removed/discharged from the tank. Each liquid reservoir has one or more pumps associated with the outlet. The pumps, when activated and in operation, transport the liquid, as required based on appropriate control signals.

A single operator may have responsibility for many pump stations scattered over vast geographic areas, for instance the operator may have responsibility for hundreds or thousands of individual pumps. It is known to maintain and service pumps and pump stations at regular time intervals. However, this may result in pumps that are operating within acceptable parameters being serviced when not needed, and faulty pumps not being serviced when needed, thus resulting in failure. It is also known to monitor pump operating parameters, such as the individual pump efficiency (the electrical energy required to move a fixed volume of liquid), to determine whether a pump station is operating within acceptable parameters, and normal pump station service is based on the monitored parameters. However, the pump stations operate under different conditions, i.e. different operational environments, in relation to each other and also over time.

The population of urban areas, and the presence of industries and companies, change all the time and thereby the generation of wastewater change over time in each specific area. Each wastewater transportation system, upon installation, is designed to handle a theoretical amount of wastewater. However, after installation and over time there is no good way to determine the capacity utilization or capacity shortage risk of the system and of different pump stations, there is also no optimal automatic way to decide/prioritise what part of the wastewater system and/or pump stations, that need to be upgraded or need service/maintenance. New pump stations are always over dimensioned in order to be able to receive and transport an increasing amount of wastewater. But it is hard to predict/monitor when the excess output capacity of the pump station is running low.

Another factor effecting the pump station capacity utilization is precipitation, e.g. rain, snow, etc., in the area of the pump station. In some areas the rainwater is mixed with the sewage and transported in the pump station system, socalled combined systems. However, in most areas the rainwater is not mixed with the sewage but is handled separately and is infiltrated into the ground or taken care of separately. Independently of method, rainwater will enter the pump stations as inflow. In areas having separate water handling systems, the rainwater will enter the pump stations via direct inflow and/or via infiltration into the piping leading to the pump station. Older pump stations and piping becomes more and more prone to in-leakage with age and will receive more rainwater than a newer pump station and piping. Thereto, there is also illegal/incorrect connection of collected rain water to the sewage system. Thus, the precipitation effect will change over time and is different for each pump station.

OBJECT OF THE INVENTION

The present invention aims at obviating the aforementioned disadvantages and failings of previously known pump station monitoring and control systems, i.e. surveillance and estimation systems.

A primary object of the present invention is to provide an improved method for monitoring and controlling pump stations, whereby an operator may more accurately compare the performance of different pump stations working under different environmental conditions and especially determine if any of the pump stations has an output capacity shortage risk, i.e. needs upgrading due to increasing inflow condition. The capacity shortage risk is an estimation whether the pump station will be able to handle theoretical peak total inflow origination from sewage and from precipitation, or become flooded. Wherein the theoretical peak total inflow is based on historical data and expected/estimated data.

It is an object of the present invention to provide an improved method for monitoring pump stations, whereby an operator may understand the pump station performance in relation to real life conditions and may determine available capacity margins of the pump stations.

It is an object of the present invention to provide an improved method for monitoring pump stations, whereby the method is proactive and provides tools for the operator to decide about investments.

SUMMARY OF THE INVENTION

According to the invention at least the primary object is attained by means of the initially defined method for determining a pump station capacity measure, i.e. monitoring and controlling the operation of a pump station, having the features defined in the independent claim. Preferred embodiments of the present invention are further defined in the dependent claims.

According to the present invention, there is provided a method for determining a pump station capacity measure in relation to a theoretical/estimated or actual Precipitation Event in the area of the pump station, wherein the pump station comprises a tank for temporary storage of a liquid, an inlet for influent liquid, an outlet and at least one pump configured for transporting the liquid away from the tank via said outlet, the method is characterized by the steps of:

determining a Precipitation Inflow character (IN-RAIN) of the pump station (1) that is representative for the inflow of liquid to the pump station (1) originating from theoretical or actual Precipitation Events in the area of the pump station (1), determining a Dry Inflow character (IN-DRY) of the pump station (1) that is representative for the inflow of liquid to the pump station (1) not originating from Precipitation Events, determining a Pump Station Max Capacity (PSMC) that is representative for the maximum output capacity of the pump station (1), and determining the Pump Station Capacity Measure (PSCM) based on:

a maximum value of said Precipitation Inflow character MAX(IN-RAIN), a maximum value of the Dry Inflow character MAX (IN-DRY), and said Pump Station Max Capacity (PSMC).

Thus, the present invention is based on the insight of determining a Pump Station Capacity Measure (PSCM) for the pump station based on known/monitored/measured historical data regarding the water inflow to the pump station, the maximum output capacity of the pump station and thereto weather data for the area of the specific pump station. Thus, the inventor has realized that it is crucial to take into account that the total Inflow (IN) to a pump station is constituted by wastewater/sewage inflow (IN-DRY) and inflow origination from precipitation (IN-RAIN), both in combined systems and separated systems. This Pump Station Capacity Measure (PSCM) is a capacity shortage risk assessment/estimation, i.e. risk of flooding for different pump stations in a situation when the maximum inflow originating from precipitation coincides with maximum inflow of sewage, providing the operator input for deciding about upgrading strategy/flooding strategy/priority of the different pump stations and/or piping in a pumping/wastewater network.

In particular, the determination of upgrading need is highly improved with the inventive method as values of the Pump Station Capacity Measure (PSCM) are comparable over time, i.e. before and after a change or service of the pump and/or parts of the pump station which is not possible with known methods. Thereto, by means of the inventive method different pump stations may be compared with each other. Thus, the operator is given a method that will help the operator to prioritize investments in a pumping network.

The Pump Station Capacity Measure (PSCM) over time will elucidate how an increasing population in the area of the pump station and thereby increased inflow consumes the initial over dimension of the pump station, and will also elucidate whether precipitation characteristics in the area of the pump station and in-leakage is changing and its effect on the inflow to the pump station.

In various example embodiments of the present invention the maximum value of the Precipitation Inflow character MAX(IN-RAIN) corresponds to a Precipitation Value (RAIN) that is representative for the period having the heaviest precipitation during said theoretical or actual Precipitation Event in the area of the pump station, using a predetermined correlation function wherein the maximum value of the Precipitation Inflow character MAX(IN-RAIN) is proportional to the Precipitation Value (RAIN): MAX(IN-RAIN)−(RAIN).

According to various example embodiments of the present invention the correlation function is: MAX(IN-RAIN) =a*(RAIN)^b−c, wherein the correlation factors a, b and c are predetermined, and based on historical Precipitation Events in the area of the pump station.

Based on said correlation function a theoretical Precipitation Event in the area of the pump station, i.e. a 50-year rain having a predefined amount of rain per time segment, can be used to predict the risk for flooding should such a rain coincide with maximum inflow of sewage.

According to various example embodiments of the present invention the Precipitation Inflow character (IN-RAIN) during the Precipitation Event is determined per time segment using the formula: (IN-RAIN)=(IN)−NORM(IN-DRY), wherein the normal Dry Inflow character NORM(IN-DRY) is representative for a normal inflow of liquid to the pump station per time segment, during periods of no Precipitation Event in the area of the pump station, and wherein the Inflow (IN) is representative for the total inflow of liquid to the pump station per time segment during the Precipitation Event.

According to various example embodiments of the present invention the Inflow (IN) is determined by the sub-steps of: determining a rest-time (REST) required for the liquid level in the tank to rise from a pump stop liquid level (STOP) to a pump start liquid level (START) when no pump is active, and determining the Inflow (IN) by dividing the volume (V) by the determined rest-time (REST), [V/REST], wherein the volume (V) is the liquid volume in the tank between said pump start liquid level (START) and said pump stop liquid level (STOP).

It is advantageous to use said rest-time (REST) and run-time (RUN) that is already available in most pump station monitoring units.

According to various example embodiments of the present invention the Pump Station Capacity Measure (PSCM) is determined using the formula: PSCM=100*MAX(IN)/PSMC, wherein the maximum Inflow MAX(IN) is representative for total inflow of liquid to the pump station (1) in response to the determined maximum value of the Precipitation Inflow character MAX(IN-RAIN) coinciding with the maximum value of the Dry Inflow character MAX(IN-DRY) using the formula: MAX(IN)=MAX(IN-RAIN)+MAX(IN-DRY).

In yet another aspect of the present invention it is provided a non-transitory computer-readable storage medium having computer-readable program code portions embedded therein, wherein the computer-readable program code portions when executed by a computer cause the computer to carry out the steps of the method according to claim 1 in order to determine a Pump Station Capacity Measure (PSCM).

Further advantages with and features of the invention will be apparent from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawing, wherein:

FIG. 1 is a schematic view of an example embodiment of a pump station according to the present invention.

DETAILED DESCRIPTION OF PREFERRED EMBODIMENTS OF THE INVENTION

The invention is applicable to a pump station and concern monitoring and control of a pump station. Reference is initially made to FIG. 1 illustrating a pump station 1, e.g. a wastewater pump station, however other liquids may be pumped and the invention is not limited to wastewater.

The pump station 1 comprises at least one pump 2 having an inlet 3 and an outlet 4, an outlet pipe 5 connected to the pump 2 and extending from the pump outlet 4. The pump station 1 comprises a tank 6, also known as reservoir, sump, etc. configured for temporary storage of liquid. The pump station 1 comprises an inlet 7 for incoming/influent liquid and an outlet 8 for discharged/effluent liquid. The pump 2 is configured for transporting the liquid away from the tank 6 via the outlet pipe 5 and said outlet 8. The pump 2 is preferably located in the tank 6, and the pump 2 may be located in partly or fully submerged position or in a dry position, or located in a dry position outside the tank 6.

The disclosed pump station 1 also comprises a level sensor 9 located in the tank 6 and preferably in a position always submerged when the pump station 1 is in operation. Thus, the level sensor 9 is preferably located below the inlet 3 of the pump 2. According to various alternative embodiments the level sensor is constituted by a dry installed level sensor, e.g. using ultrasound, radar, etc., hanging above the liquid level and/or located outside the tank 6. According to various embodiments the pump station 1 comprises a plurality of level sensors, such as level switches located at different levels in the tank, e.g. start level and stop level, which will be tilted/manipulated by the liquid surface. The purpose of the level sensor 9, or level sensors, is to start and stop the pump 2 when the liquid surface is located at predetermined levels within the tank 6.

Usually, the pump stations 1 comprises at least two pumps, wherein the second pump is used to prevent flooding and/or as a backup if the first pump malfunctions and/or the plurality of pumps alternate. The second pump having an inlet and an outlet, an outlet pipe 10 extending from the pump outlet and is connected to the outlet pipe 5 of the first pump 2. The pump station 1 may comprise one or more non-return valves 11 arranged to prevent the pumped flow from one of the pumps to return to the tank 6 via the other pump, and also to prevent the liquid in the outgoing piping from returning to the tank 6 when the pumps are deactivated. The plurality of pumps 2 may be of the same or different size, i.e. rated power and capacity.

A local control unit 12 is operatively connected to the pumps 2 and to different sensors in the pump station 1, and may further be operatively connected to a remote/external control unit (not shown). The local control unit may by partly or fully located inside the pump 2. External outlet piping is connected to the outlet 8 of the tank 6 and the external outlet piping guides the pumped liquid for example to another pump station and/or a wastewater plant. Everything described in connection with said at least one pump 2 is applicable also for the other pumps in the pump station 1. During operation of the pump station 1 the liquid level 13 in the tank 6 will rise and fall depending on the influent liquid and the operation of the pumps 2.

The inventive method comprises the steps of:

determining a Precipitation Inflow character (IN-RAIN) of the pump station 1 that is representative for the inflow of liquid to the pump station 1 originating from theoretical or actual Precipitation Events in the area of the pump station 1, determining a Dry Inflow character (IN-DRY) of the pump station 1 that is representative for the inflow of liquid to the pump station 1 not originating from Precipitation Events, determining a Pump Station Max Capacity (PSMC) that is representative for the maximum output capacity of the pump station 1, and determining the Pump Station Capacity Measure (PSCM) based on:

a maximum value of said Precipitation Inflow character MAX(IN-RAIN), a maximum value of the Dry Inflow character MAX (IN-DRY), and said Pump Station Max Capacity (PSMC).

Thus, the total inflow to the pump station 1 comprises two components, (IN-DRY) that is inflow of liquid originating from sewage/wastewater from households, industries, restaurants, schools, hotels, etc. and (IN-RAIN) that is inflow of liquid originating from Precipitation Events, such as rain. The term dry inflow comes from when the weather is dry, i.e. no precipitation.

The Dry inflow character (IN-DRY) is based on historical data for the specific pump station 1 and/or theoretical data that takes into account future expected/predicted inflow following an increase in wastewater load in the area of the pump station 1, i.e. more households, etc. The Dry inflow character (IN-DRY) is a component representing the change of momentary inflow of liquid over time, when the weather is dry, i.e. inflow of liquid as a function of time.

It is known that the dry inflow to a pump station 1 alters during the day, during the week and sometimes also during the year. By monitoring the actual total inflow to the pump station 1 over time and recording data when there is no water from precipitation reaching the pump station, i.e. when there has not been any precipitation for a longer time period such that the grounds has dried out, one will eventually obtain a good representation over the inflow of liquid to the pump station 1 not originating from Precipitation Events. The dry flow character (IN-DRY) discloses the fluctuation over 24 hours, for instance the same fluctuation for every day of the year, or different fluctuation between weekdays and weekends, or different fluctuations between the seasons/months/weeks/days of the year.

The maximum value of the Dry Inflow character MAX (IN-DRY), usually given in liters/second, i.e. the maximum inflow of liquid per time unit, may be constituted by the historical/predicted maximum value of the dry inflow, or may be an average from a plurality of the highest values of the dry inflow, or may be a statistically significant maximum value of the dry inflow, etc. The historical data is preferably washed/cleaned in order to remove noise/disturbances before the maximum value of the Dry Inflow character MAX(IN-DRY) is determined. A predicted maximum value of the Dry Inflow character MAX(IN-DRY) may for instance be based on historic data from another known pump station, or a predicted maximum based on known urban development of the area of the pump station. The maximum value of the Dry Inflow character MAX(IN-DRY) is the peak inflow amount to the tank 6 of the pump station 1 directly originating from wastewater/sewage from households, etc. Thus, the maximum value of the Dry Inflow character MAX(IN-DRY) is representative for the time segment/period that has the expected highest inflow of liquid to the pump station (1) not originating from Precipitation Events.

The Precipitation Inflow character (IN-RAIN) is a component representing the change of momentary inflow of liquid over time, liquid originating from Precipitation Events, i.e. inflow of liquid as a function of time. The maximum value of Precipitation Inflow character MAX(IN-RAIN), usually given in liters/second, i.e. the maximum inflow of liquid per time unit, is based on historical and/or theoretical data regarding Precipitation Events in the area of the pump station 1. For instance, historical data is used to determine the direct effect that rain has on the total inflow to the pump station 1, and theoretical data is used to predict whether a theoretical rain, such as a 10-year rain or a 25-year rain, will flood the pump station 1 or not. The maximum value of Precipitation Inflow character MAX(IN-RAIN) is the peak inflow amount to the tank 6 of the pump station 1 directly originating from a Precipitation Event in the area of the pump station, i.e. liters/second.

The maximum value of the Precipitation Inflow character MAX(IN-RAIN) corresponds to a Precipitation Value (RAIN), usually given in millimetres/hour, that is representative for the time period having the heaviest precipitation during said theoretical or actual Precipitation Event in the area of the pump station 1. Thus, there is a predetermined correlation function wherein the maximum value of the Precipitation Inflow character MAX(IN-RAIN) is proportional to the Precipitation Value (RAIN): MAX(IN-RAIN)–(RAIN). The correlation function is also called transfer function. It shall be understood that the time period having the heaviest precipitation, millimeters/time unit, does not usually coincide with the time period of maximum value of the Precipitation Inflow character MAX(IN-RAIN). The maximum value of the Precipitation Inflow character MAX (IN-RAIN) is delayed since it takes some time for the rain to reach the pump station.

Said time period during the Precipitation Event, may be one hour but is preferably less than one hour since the most pump stations 1 are designed to activate the pumps 2-20 times per hour, in order to prevent sedimentation in the tank 6 and in order to provide an even flow of liquid to downstream stations. In the case the time period is less than one hour, the quantity is still millimetres/hour. Thereto, said time period may be divided into time segments, each being for instance in the range 5-60 minutes long, preferably 10-30 minutes long. The length of the time segment is preferably equal to the time slots into which the historical/theoretical precipitation values for the area of the pump station 1 is provided. Such historical/theoretical precipitation values are provided by meteorological institutes/organizations, airports, national road administration, local authorities, etc. monitoring precipitation. The measuring shall preferably be made within a radius of 2000 meters, more preferably within a radius of 1000 meters, more preferably within a radius of 500 meters.

According to various embodiments the correlation function is:

MAX(IN-RAIN)=a*(RAIN)ˆb−c, wherein the correlation factors [a], [b] and [c] are predetermined, and based on historical Precipitation Events in the area of the pump station 1.

Correlation factor [a] is a measure how large ratio of the precipitation that will reach the tank 6 of the pump station 1, correlation factor [b] is a measure how said ratio changes by increasing precipitation and the correlation factor [c] is a measure referring to the ability of the ground to keep water before any of the precipitation reaches the tank 6 of the pump station 1.

It shall be pointed out that the correlation function may also be extended to comprise another correlation factor [d] that modifies the correlation function to also account for the time elapsed from last rain/precipitation, i.e. if the ground is saturated with water or if the ground/subsoil water is low.

According to various embodiments the Precipitation Value (RAIN) is equal to the single time segment having the heaviest precipitation during said theoretical or actual Precipitation Event, or is preferably equal to an average time segment value determined from a plurality of time segments including the time segment having the heaviest precipitation during said theoretical or actual Precipitation Event. For instance the time segment direct before and the time segment direct after the time segment having the heaviest precipitation during said theoretical or actual Precipitation Event are included in order to determine the average time segment value. It is also perceivable that two or three time segments direct before and direct after the time segment having the heaviest precipitation during said theoretical or actual Precipitation Event are included in order to determine the average time segment value. Thus, three or more consecutive time segments mutually having almost the same precipitation/rain, i.e. heavy and persistent rain, will in most situations provide a different Precipitation Inflow character MAX(IN-RAIN) than a single time segment having heavy rain, i.e. a short and intense rain shower. It is also conceivable to determine the Precipitation Value (RAIN), that is representative for the precipitation event, in other ways based on for instance the total precipitation amount, the highest value of a single time segment, the total length of the precipitation event, etc.

According to various embodiments the Precipitation Inflow character (IN-RAIN) during the Precipitation Event is determined per time segment using the formula: (IN-RAIN)=(IN)–NORM(IN-DRY), wherein the normal Dry Inflow character NORM(IN-DRY) is representative for a normal inflow of liquid to the pump station 1 per time segment, i.e. liters/second, during periods of no Precipitation Event in the area of the pump station 1, and wherein the Inflow (IN) is representative for the total inflow of liquid to the pump station 1 per time segment during the Precipitation Event, i.e. inflow of liquid as a function of time.

It shall be pointed out that the time segment having the heaviest rain/precipitation during the Precipitation Event, most often, does not coincide with the time segment having the maximum value of the Precipitation Inflow character MAX(IN-RAIN), since there is at least some time lagging before the water reaches the tank 6 of the pump station 1.

According to various embodiments the Inflow (IN) is determined by the sub-steps of:

- determining a rest-time (REST) required for the liquid level 13 in the tank 6 to rise from a pump stop liquid level (STOP) to a pump start liquid level (START) when no pump 2 is active, and
- determining the Inflow (IN) by dividing the volume (V) by the determined rest-time (REST), [V/REST], wherein the volume (V) is the liquid volume in the tank 6 between said pump start liquid level (START) and said pump stop liquid level (STOP).

When no pump 2 is active is defined as no liquid is discharged from the pump station. Thus, a slowly rotating impeller in the pump will not generate any outflow and the pump 2 is defined as inactive.

An alternative to use the pump start liquid level (START) and/or the pump stop liquid level (STOP), is to use two other known/preset liquid levels in the tank 6 wherein the volume of the tank 6 between the two known liquid levels is known. Such levels may be closer to each other than the pump start liquid level (START) and the pump stop liquid level (STOP), and thereby a more rapid determination of the Inflow (IN) is made. One of the two known liquid levels may be constituted by the pump start liquid level (START) or the pump stop liquid level (STOP).

Thus, on a more general level, herein the volume (V) shall be regarded as a predetermined volume in the tank 6, which volume is delimited by an upper liquid level (UP) and a lower liquid level (LOW), and the rest-time (REST) shall be determined using the lower liquid level (LOW) and the upper liquid level (UP), wherein pump start liquid level (START) and pump stop liquid level (STOP) are specific values of the general terms upper liquid level (UP) and lower liquid level (LOW), respectively.

Thus, according to various embodiments the step of determining the Inflow data (IN) comprises the sub-steps of:

- determining a rest-time (REST) required for the liquid level in the tank 6 to rise from a lower liquid level (LOW) to an upper liquid level (UP) when no pump 2 is active,
- determining the Inflow (IN) by dividing a volume (V) by the determined rest-time (REST), [V/REST], wherein the volume (V) is the liquid volume in the tank 6 between said upper liquid level (UP) and said lower liquid level (LOW).

Another alternative is to use a fixed rest-time (REST) and then monitor the liquid levels 13 in the tank, and based on these liquid levels, i.e. lower liquid level (LOW) and upper liquid level (UP), determine the inflow during the predetermined time.

According to alternative embodiments the Inflow (IN) is determined using an inlet flowmeter 14.

According to various preferred embodiments, the Pump Station Capacity Measure (PSCM) is determined using the formula: PSCM=100*MAX(IN)/PSMC, wherein the maximum Inflow MAX(IN) is representative for total inflow of liquid to the pump station 1 in response to the determined maximum value of the Precipitation Inflow character MAX (IN-RAIN) coinciding with the maximum value of the Dry Inflow character MAX(IN-DRY) using the formula: MAX (IN)=MAX(IN-RAIN)+MAX(IN-DRY) Thereby it is determined what safety margin the pump station 1 has if a heavy, theoretical or actual, Precipitation Events in the area of the pump station 1 coincide with a maximum value of normal dry inflow, or if the pump station 1 will be flooded in such a situation.

The Pump Station Max Capacity (PSMC) may be changing over time due to wear, clogging of pipes, etc. and is given as volume per time unit, i.e. liters/second. The change over time is however slow, i.e. months/years, and the Pump Station Max Capacity (PSMC) may be updated periodically. The Pump Station Max Capacity (PSMC) is dependent on the size/capacity of the pumps, the design and clogging status of the outlet piping, etc.

According to various embodiments, the Pump Station Max Capacity (PSMC) may be determined theoretically/mathematically.

According to various embodiments, the step of determining the Pump Station Max Capacity (PSMC) comprises the sub-steps of:

- determining a run-time (RUN) required for the liquid level 13 in the tank 6 to lower from a pump start liquid level (START) to a pump stop liquid level (STOP) when all pumps 2 in the pump station 1 are active concurrently and operated at maximum operational speed, and
- determining the Pump Station Max Capacity data (PSMC) that is representative for the maximum output capacity of the pump station 1 by dividing a volume (V) by the determined run-time (RUN) and adding Inflow (IN) that is representative for the total inflow of liquid to the pump station 1 per time segment, [(V/RUN)+IN], wherein the volume (V) is the liquid volume in the tank 6 between said pump start liquid level (START) and said pump stop liquid level (STOP).

An alternative to use the pump start liquid level (START) and/or the pump stop liquid level (STOP), is to use two other known/preset liquid levels in the tank 6 wherein the volume of the tank 6 between the two known liquid levels is known. Such levels may be closer to each other than the pump start liquid level (START) and the pump stop liquid level (STOP), and thereby a more rapid determination of the Pump Station Max Capacity (PSMC) is made. One of the two known liquid levels may be constituted by the pump start liquid level (START) or the pump stop liquid level (STOP).

Thus, on a more general level, herein the run-time (RUN) shall be determined using said upper liquid level (UP) and said lower liquid level (LOW).

Thus, according to alternative embodiments, when all pumps 2 are active concurrently and are operated at maximum operational speed, the step of determining the Pump Station Max Capacity data (PSMC) comprises the sub-steps of:

- determining a run-time (RUN) required for the liquid level in the tank 6 to lower from the upper liquid level (UP) to the lower liquid level (LOW), and
- determining the Pump Station Max Capacity data (PSMC) that is representative for the maximum output capacity of the pump station 1 by dividing a volume (V) by the determined run-time (RUN) and adding the Inflow data (IN) representative for the inflow of liquid during the predetermined time segment, [(V/RUN)+IN], wherein the volume (V) is the liquid volume in the tank 6 between said upper liquid level (UP) and said lower liquid level (LOW).

Another alternative is to use a fixed run-time (RUN) and then monitor the liquid levels 13 in the tank, and based on these liquid levels determine the pumped volume during the predetermined time.

According to alternative embodiments the Pump Station Max Capacity (PSMC) is determined using an outlet flowmeter 15, i.e. the maximum output capacity.

When using the preferred embodiments to determine the Inflow (IN) and the Pump Station Max Capacity (PSMC) the volume (V) parameter is both in the numerator and in the denominator and can be omitted/excluded.

The output capacity is the amount of liquid that can be transported from or through the pump station 1. The output capacity is dependent on the max capacity of the different pumps, outlet piping diameters, and wear and condition of pumps and piping. Capacity utilization is the incoming flow of liquid compared to the pump station 1 output capacity.

The Pump Station Max Capacity data (PSMC) is the maximum Outflow ($Q_M$) corresponding to all pumps 2 in the pump station 1 being active concurrently and operated at maximum operational speed, e.g. rated operational speed. The maximum Outflow ($Q_M$) will change over time due to wear of the pumps 2, clogging of the outlet piping, size of the pumps 2, size of the outlet piping, number of pumps 2 in the pump station 1, etc. Thus, the Pump Station Max Capacity (PSMC) shall provide a good representation of the maximum output volume from the pump station 1, i.e. from the pumps 2 of the pump station 1. It shall be pointed out that in some pump stations and/or during certain situations, not all installed pumps 2 in a pump station 1 are allowed to be active concurrently and/or be operated at rated operational speed, due to physical or design constraints of the specific pump station and/or outlet piping. Thus, herein, the term "all pumps 2 of the pump station 1 being active concurrently and operated at maximum operational speed" shall be understood to mean "the combination of pumps 2 in the pump station 1 that are allowed to be active concurrently and operated at maximum allowable operational speed and that provides the maximum outflow ($Q_M$) from the pump station 1". Thus, the maximum allowable speed providing the maximum outflow ($Q_M$) from the pump station may not necessarily be the rated operational speed.

All pumps 2 are active concurrently and are operated at maximum/rated operational speed is for instance during a so-called outlet pipe cleaning sequence, that can be scheduled in the control unit 12, manually initiated by an operator, automatically initiated by the control unit 12 based on need, or during high inflow wherein one pump 2 is not sufficient. In a well-functioning and properly dimensioned pump station 1 there is almost never need for all pumps 2 to be active concurrently and be operated at maximum/rated operational speed in order to handle the incoming liquid.

According to various embodiments the pump station 1 comprises a plurality of pumps 2, and these pumps are constituted by a first subset of pumps (P1) and a second subset of pumps (P2). In most pump stations 1 the first subset of pumps (P1) and the second subset of pumps (P2), respectively, is constituted by a single pump 2, however, the first subset of pumps (P1) and/or the second subset of pumps (P2) may comprise a plurality of pumps 2.

The Pump Station Max Capacity (PSMC) is in such situations mathematically determined based on the Max Capacity of the first subset of pumps and the Max Capacity of the second subset of pumps. It shall be pointed out that the Pump Station Max Capacity (PSMC) is not the sum of the Max Capacity of the first subset of pumps and the second subset of pumps, but the sum of them has to be multiplying by reduction factor (X), wherein the reduction factor is in the range 0.6-0.9. This phenomenon comes from increasing flow resistance in the outlet piping in relation to increasing flow velocity.

When all pumps 2 are not active concurrently and the active pumps 2 are operated at a reduced operational speed that is less than the maximum operational speed, there must be a compensation in order to be able to determine the above run-times of the first subset of pumps (P1) and the second subset of pumps (P2). For each subset of pumps in the specific pump station 1, there is a known/predetermined relationship between the operational speed and outflow. The maximum operational speed provides a maximum outflow and a reduced operational speed provides a reduced outflow. The pumps 2 comprises internal and/or external Variable Frequency Drive (VFD) in order to be operated at reduced operational speed.

Thus, when the pumps of the first subset of pumps (P1) are active concurrently and operated at a reduced operational speed, said reduced operational speed corresponds to a reduced first Outflow (P1_$Q_R$) and an actual first run-time (P1_RUNA) required for the liquid level in the tank 6 to lower from a pump start liquid level (START) to a pump stop liquid level (STOP). The determination of the first run-time (P1_RUN) comprises multiplying the actual first run-time (P1_RUNA) with the ratio between the reduced first Outflow (P1_$Q_R$) and a maximum first Outflow (P1_$Q_M$), wherein the ratio between the reduced first Outflow (P1_$Q_R$) and the maximum first Outflow (P1_$Q_M$) is determined based on a predetermined relationship between operational speed and first Outflow (P1_Q), and the reduced operational speed. The same applies for the second subset of pumps.

In line with the above, please note that first run-time, second run-time, first rest-time, second rest-time, etc. alternatively may be determined using the general terms upper liquid level (UP) and lower liquid level (LOW) instead of the specific terms pump start liquid level (START) and the pump stop liquid level (STOP).

A non-transitory computer-readable storage medium having computer-readable program code portions embedded therein, wherein the computer-readable program code portions when executed by a computer cause the computer to carry out the steps of the inventive method in order to determine a Pump Station Capacity Measure (PSCM). The computer program product is preferably arranged in the control unit 12, in an external computer, in the cloud, in a service/diagnosis tool, a tablet/mobile phone, etc. that is connectable to the pump or pump station by wire or wireless.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims.

Throughout this specification and the claims which follows, unless the context requires otherwise, the word "comprise", and variations such as "comprises" or "comprising", will be understood to imply the inclusion of a stated integer or steps or group of integers or steps but not the exclusion of any other integer or step or group of integers or steps.

Flow is per definition volume per time unit.

The invention claimed is:

1. A method for determining a Pump Station Capacity Measure (PSCM) value in relation to a theoretical or actual Precipitation Event as calculated or measured using a source of precipitation information data in an area of a pump station, the pump station comprising a tank for temporary storage of a liquid, an inlet for influent liquid, an outlet, at least one pump configured for transporting the liquid away from the tank via the outlet, at least one control unit connected to the at least one pump, to at least one sensor operatively mounted on the pump station, to the source of precipitation data information, and to a variable frequency drive operative to control a speed of the at least one pump, the at least one sensor selected from the group consisting of: one or more liquid level sensors configured to measure a liquid level in the tank, a flowmeter configured to measure the inflow, and a flowmeter configured to measure outflow, the method comprising the steps of:

with the at least one control unit:

determining a Precipitation Inflow character (IN-RAIN) of the pump station representative of the inflow of the influent liquid to the pump station originating from the theoretical or actual Precipitation Event in the area of the pump station, determining a Dry Inflow character (IN-DRY) of the pump station representative of the inflow of the influent liquid to the pump station not originating from the theoretical or actual Precipitation Events, determining the Pump Station Max Capacity (PSMC) value representative of a maximum output capacity of the pump station, and determining the Pump Station Capacity Measure (PSCM) value based on:

a maximum value of the Precipitation Inflow character MAX(IN-RAIN), a maximum value of the Dry Inflow character MAX (IN-DRY), and the Pump Station Max Capacity (PSMC); and operating the drive for the at least one pump at a maximum/rated operational speed: at a scheduled time, in response to manual initiation by an operator, or automatically based upon a need as determined by the at least one control unit, and operating the drive for the at least one pump otherwise at a reduced operational speed less than the maximum/rated operational speed.

2. The method according to claim 1, wherein:

the maximum value of the Precipitation Inflow character MAX(IN-RAIN) corresponds to a Precipitation Value (RAIN) representative of a period having heaviest precipitation during the theoretical or actual Precipitation Event in the area of the pump station, using a predetermined correlation function; and the maximum value of the Precipitation Inflow character MAX(IN-RAIN) is proportional to the Precipitation Value (RAIN).

3. The method according to claim 2, wherein:

the correlation function includes correlation factors a, b, and c, and a correlation formula $$MAX(IN\text{-}RAIN)=a*(RAIN)^{b}-c,$$

and;

the correlation factors a, b and c are predetermined, and based on historical Precipitation Events in the area of the pump station.

4. The method according to claim 3, wherein the Precipitation Value (RAIN) is equal to a time segment having the heaviest precipitation during the theoretical or actual Precipitation Event, or is equal to an average time segment value determined from a plurality of time segments including the time segment having the heaviest precipitation during the theoretical or actual Precipitation Event.

5. The method according to claim 1, wherein the Precipitation Inflow character (IN-RAIN) during the Precipitation Event is determined per time segment using a formula:

$$(IN\text{-}RAIN)=(IN)-NORM(IN\text{-}DRY),$$

wherein the normal Dry Inflow character NORM(IN-DRY) is representative of a normal inflow of the influent liquid to the pump station per time segment, during periods lacking the theoretical or actual Precipitation Event in the area of the pump station, and wherein the Inflow value (IN) is representative of a total inflow of the influent liquid to the pump station per time segment during the Precipitation Event.

6. The method according to claim 5, wherein the Inflow value (IN) is determined by sub-steps of:

determining a rest-time (REST) required for a liquid level in the tank to rise from a pump stop liquid level (STOP) to a pump start liquid level (START) when all pumps of the at least one pump are inactive, and determining the Inflow value (IN) by dividing the volume value (V) by the determined rest-time (REST), [V/REST], wherein the volume value (V) is a liquid volume in the tank between the pump start liquid level (START) and the pump stop liquid level (STOP).

7. The method according to claim 1, wherein the maximum value of the Dry Inflow character MAX(IN-DRY) is representative of a time segment having the expected highest inflow of the influent liquid to the pump station originating outside Precipitation Events.

8. The method according to claim 1, wherein the Pump Station Capacity Measure (PSCM) is determined using a PSCM formula:

$$PSCM=100*MAX(IN)/PSMC,$$

wherein the maximum Inflow MAX(IN) is representative of a total inflow of the influent liquid to the pump station in response to the determined maximum value of the Precipitation Inflow character MAX(IN-RAIN) coinciding with the maximum value of the Dry Inflow character MAX(IN-DRY) using a maximum Inflow formula:

$$MAX(IN)=MAX(IN\text{-}RAIN)+MAX(IN\text{-}DRY).$$

9. The method according to claim 1, wherein the step of determining the Pump Station Max Capacity (PSMC) comprises sub-steps of:

determining a run-time (RUN) required for a liquid level in the tank to lower from a pump start liquid level (START) to a pump stop liquid level (STOP) when all pumps of the at least one pump in the pump station are active concurrently and operated at the maximum operational speed, and determining the Pump Station Max Capacity data (PSMC) representative of the maximum output capacity of the pump station by dividing a volume (V) by the determined run-time (RUN) and adding Inflow (IN) that is representative for the total inflow of liquid to the pump station per time segment, using a PSMC expression (V/RUN)+IN, wherein the volume (V) is a liquid volume in the tank between the pump start liquid level (START) and the pump stop liquid level (STOP).

10. A non-transitory computer-readable storage medium having computer-readable program code portions embedded therein, wherein the computer-readable program code portions when executed by a computer cause the computer to carry out the steps of the method according to claim 1 in order to determine a Pump Station Capacity Measure (PSCM).

11. The method of claim 1, wherein the at least one control unit comprises or is connected to a computer connected to a non-transitory computer-readable storage medium having computer-readable program code portions embedded therein, the computer-readable program code portions configured to be executed by the computer to cause the computer to perform the method steps.

12. The method of claim 1, further comprising transmitting the PSMC value to at least one of a surveillance system or an estimation system configured to receive respective PSMC values from a plurality of pump stations in a pumping network, at least one of the networked pump stations operating under different environmental conditions than at least one other of the networked pump stations, and with the surveillance system or the estimation system, monitoring and proactively comparing the PSCM value over time for a plurality of pump stations and determining from the monitoring and comparison if any of the pump stations has an output capacity shortage risk.

13. The method of claim 12, further comprising, prioritizing investments in the pumping network based upon the monitoring and comparison.

14. The method of claim 12, wherein the comparing step is performed before and after a change or service of the at least one pump or one or more parts of the pump station in the plurality of pump stations.

15. The method of claim 1, wherein the at least one control unit comprises one or more local control units and at least one remote/control unit.

16. The method of claim 15, wherein the one or more local control units includes at least one local control unit partly or fully located inside the at least one pump.

17. The method of claim 15, wherein the at least one control unit comprises at least one control unit external to the at least one pump.

18. The method of claim 1, wherein the source of precipitation data in the area of the pump station comprises historical/theoretical precipitation values from within a radius of 2000 meters of the pump station.

19. The method of claim 1, wherein the at least one pump comprises a plurality of pumps and the maximum output capacity of the pump station comprises operating all of the plurality of pumps at the maximum/rated operational speed and otherwise operating fewer than all of the plurality of pumps except when operation of fewer than all of the plurality of pumps is insufficient during high inflow.

* * * * *